US006698362B2

(12) United States Patent
Crevillen Pastor

(10) Patent No.: US 6,698,362 B2
(45) Date of Patent: Mar. 2, 2004

(54) CARDBOARD PALLET

(75) Inventor: Joaquin Crevillen Pastor, San Vicente del Raspeig (ES)

(73) Assignee: Sanvipalet, S.L., Alicante (ES)

( * ) Notice: Subject to any disclaimer, the term of this patent is extended or adjusted under 35 U.S.C. 154(b) by 0 days.

(21) Appl. No.: 10/182,417

(22) PCT Filed: Nov. 22, 2001

(86) PCT No.: PCT/ES01/00447

§ 371 (c)(1),
(2), (4) Date: Jul. 29, 2002

(87) PCT Pub. No.: WO02/057149

PCT Pub. Date: Jul. 25, 2002

(65) Prior Publication Data

US 2003/0000432 A1 Jan. 2, 2003

(30) Foreign Application Priority Data

Jan. 19, 2001 (ES) ..... 200100140 U

(51) Int. Cl.[7] ..... B65D 19/00
(52) U.S. Cl. ..... 108/51.3
(58) Field of Search ..... 108/51.3, 51.11, 108/56.3, 56.1

(56) References Cited

U.S. PATENT DOCUMENTS 3,407,758 A * 10/1968 Simkins ..... 108/51.3
3,685,463 A * 8/1972 Francis ..... 108/56.3
4,267,781 A * 5/1981 Powers ..... 108/56.1
5,535,668 A * 7/1996 Besaw et al. ..... 108/51.3
5,713,289 A * 2/1998 Model ..... 108/56.3
5,830,299 A * 11/1998 Teixidor Casanovas et al. ..... 108/53.3
5,832,841 A * 11/1998 Crews et al. ..... 108/51.3

FOREIGN PATENT DOCUMENTS

JP 6-171749 * 6/1994

* cited by examiner

*Primary Examiner*—Jose V. Chen
(74) *Attorney, Agent, or Firm*—Klauber & Jackson

(57) ABSTRACT

The pallet is formed from two sheets (1, 2) superposed underneath, an upper sheet (3) acting as a cover, and a series of legs (4) of inverted trunco-pyramidal configuration that are fixed on polygonal apertures (5, 5') established in the lower sheets. The legs (4) are obtained from a development in a cross, with a central sector (11) constituting the lower support surface for the leg, certain rectangular sectors (12) and some double and triangular sectors (13) folded via their mid-line in the form of an accordion. The leg shaped by folding those sectors presents certain upper and side flaps (12') positioned in notches (6) in the apertures (5), with the leg being correctly located in its place, which is finally fixed by gluing the sectors (134) and the flaps (12'), these latter being retained between the lower sheet (2) and the cover (3).

5 Claims, 5 Drawing Sheets

CARDBOARD PALLET

OBJECT OF THE INVENTION

As stated in the title to this descriptive report, this invention refers to a cardboard pallet that has been perfected in certain elements and/or parts of it, specifically in the construction and mounting of its legs, in order to provide greater strength and durability for the pallet; with the particular feature that those legs are obtained from a portion of the cardboard with suitable folding lines for shaping a hollow body by way of a bowl without any cuts or stuck parts, being sealed so that water cannot enter via the corrugation of the cardboard.

BACKGROUND OF THE INVENTION

At present, in addition to the classical wooden pallets, cardboard pallets are also used which are, of course, more economical. However, cardboard pallets suffer from a serious drawback determined by the lack of strength of their legs, due to which they undergo notable deterioration as a consequence of the humidity that the floor or surface on which they are stacked sometimes has. This humidity in the floor penetrates through the cardboard that the legs are made of, causing their deterioration and, eventually, rendering the pallet useless.

Moreover, the drawback has to be added that the configuration of the legs requires cutting and sticking of parts and/or flaps forming part of those legs and which are necessary not just in order to permit the final shaping but also in order to try to provide the leg with adequate strength.

DESCRIPTION OF THE INVENTION

The pallet of the invention, being of the type that consists entirely of cardboard, in which certain corrugated cardboard sheets are backed and fixed to each other in order to determine the body of the pallet, complemented with the legs, also of cardboard, and an upper closing cover which perimetrically embraces the said cardboard sheets, presents the particular feature that the legs are shaped starting from the folding of a portion of the corrugated cardboard, whose contour can be regarded as polygonal, presenting four sectors in the form of a cross deriving from one sector, and a central sector constituting the support base for the actual leg, in such a way that between those sectors certain double triangular sectors are defined with a notch in the outside vertex where each pair of triangular sectors meets. All the sectors are demarcated by folding lines, the rectangular sectors presenting separate prolongations that project with respect to the general contour of the cardboard portion, determining flaps for positioning and sticking on the surface of the body of the pallet, specifically on notches made in a polygonal aperture of the sheets already referred to, superposed and glued together, via which aperture the leg is introduced once it has been shaped following the appropriate folding along the said folding lines.

The configuration of each leg, once shaped, is trunco-pyramidal, the triangular sectors being folded in the form of pleats in such a way that the vertices determining the folds where the notches of each pair of triangular sectors are made meet in the centre of the upper and open part of the trunco-pyramidal body constituting the leg, providing it with great strength. It could also have any other suitable configuration.

The securing by the upper part of the flaps of each leg is achieved by means of a cardboard cover that is superposed on the upper part of the body defining the two glued sheets, this cover having certain extensions or flaps that are depressed downwards and fixed by gluing on the lower side surface of the said body formed by the two sheets, due to which the pallet becomes constituted by these two sheets and the cover, fixed together by gluing, with the complement of the legs constituted and fitted in the described manner.

The number of legs that the pallet will include will be that which is suitable in each case, though of course this depends on the size of that pallet and on the load it has to bear, said legs presenting the particular feature of not having any cut nor stuck flaps, and their being externally provided with a waterproof surface which, in combination with their structure, will cause the pallet to have greater durability and strength than conventional ones.

The mounting of the legs, which is simple, quick and economical, can be done by pressure, by punching or by suction.

Another fundamental characteristic is that the orientation of the channels corresponding to the corrugation of the cardboard is orthogonal in the two sheets, in other words, the channels of one sheet run in the transverse direction with respect to the channels of the other, while the cover will present its channels orientated in the same way as those corresponding to the lower sheet, all of which gives rise to a greater consistency in the structure of the pallet.

BRIEF DESCRIPTION OF THE DRAWINGS

In order to complement the description that is going to be made forthwith, and with the aim of aiding a better understanding of the characteristics of the invention, this descriptive report is accompanied by a set of drawings on the basis of which the innovations and advantages of the cardboard pallet produced in accordance with the object of the invention will be more easily comprehended.

FIG. 2.—Shows a representation also according to an exploded perspective view, on a larger scale, of the manner of fitting a leg, together with the specific configuration of the apertures of the two lower sheets and the portion of the upper cover that corresponds to the corner showing the expanded detail referred to.

DESCRIPTION OF AN EMBODIMENT OF THE INVENTION

Figure 1:
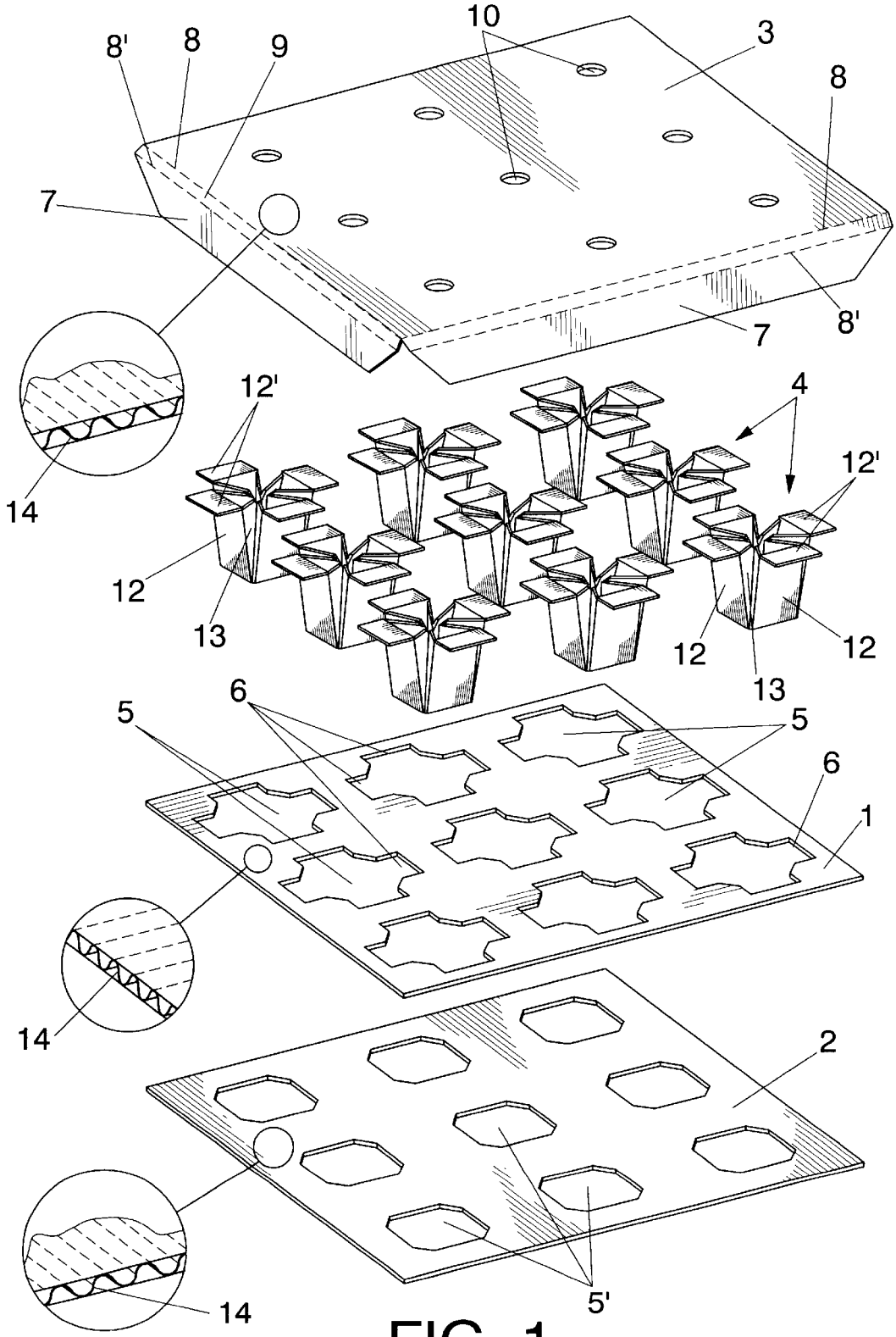
FIG. 1.—Shows a representation according to an exploded perspective view of the different components involved in the creation of a pallet carried out in accordance with the object of the invention, in which can be seen the two lower sheets with their corresponding apertures, the legs in their final shape and the upper cover, and where certain details can also be appreciated which have been extracted in order to see the orientation of the channels of the corrugated cardboard which, as can be seen, are orthogonal in the lower two sheets, while those of the upper cover display the same orientation as those of the lower sheet.
Figure 2:
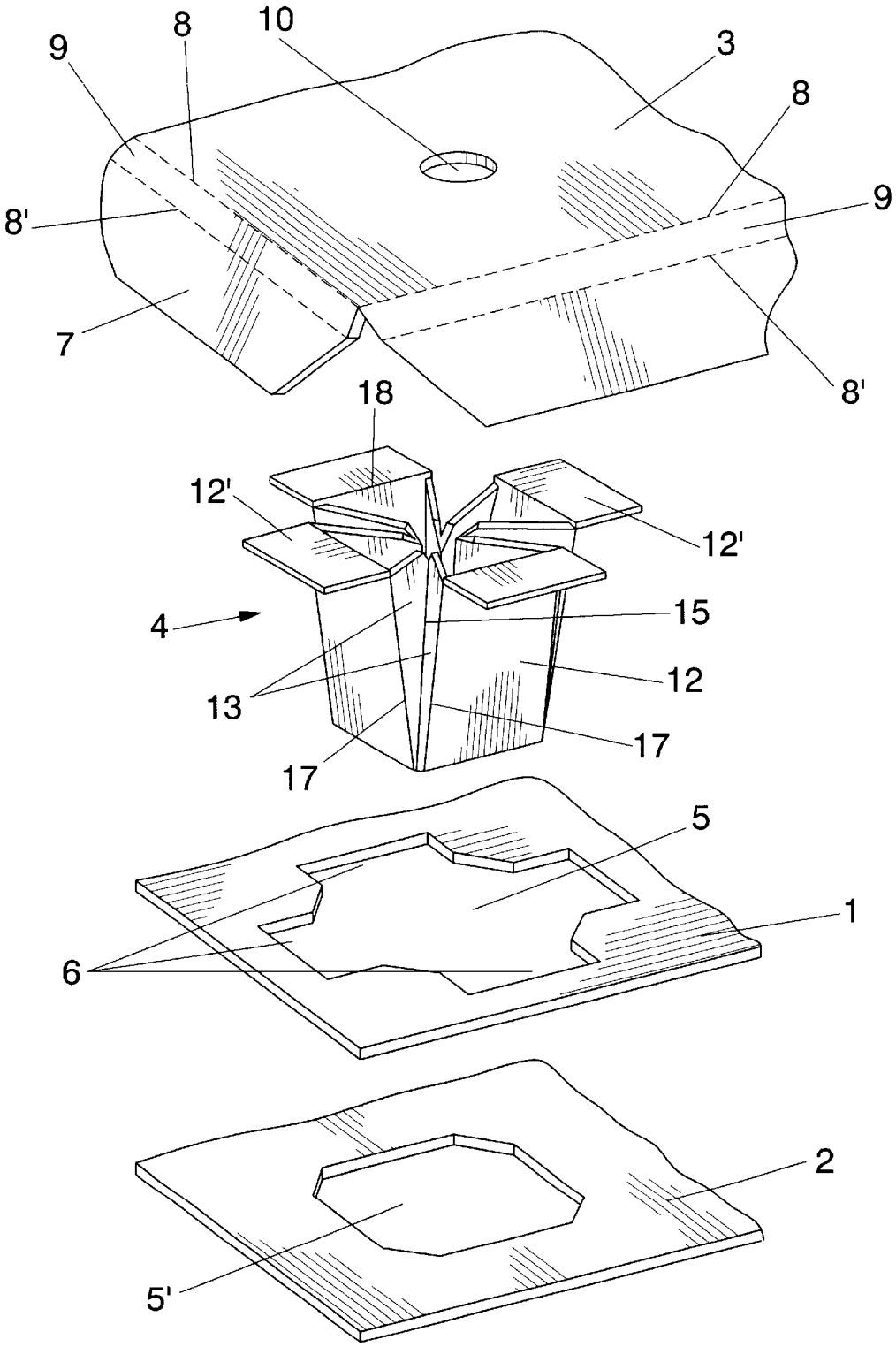

With the aforementioned figures in view, it can be seen how the pallet of the invention presents a structure determined by a pair of sheets 1 and 2 superposed on each other and fixed together by gluing, an upper cover 3 and an array of legs 4 duly linked to the structure formed by those sheets 1 and 2 and cover 3, all those components being made from corrugated cardboard in which the orientation of the channels 14 is orthogonal in sheets 1 and 2, while the channels 14 of the cover 3 present a direction orthogonal to those of the upper sheet 1 on which it rests and therefore having the same direction as those of the lower sheet 2.

The said sheets 1 and 2 contain polygonal openings or apertures 5 and 5' with a contour complementary to that of the legs, since the latter are housed in those apertures; with the particular feature that the apertures 5 of the upper sheet 1 present four rectangular notches 6 in opposition by pairs, in other words in a cross.

For its part, the cover 3 presents certain perimetric extensions or flaps 7 obtained starting from a pair of folding lines 8 and 8', all this in such a manner that in the superposition of that cover 3 on the upper sheet 1, the contour demarcated by the folding lines 8 corresponds to that of those sheets, while the band 9 demarcated between the two folding lines 8 and 8' corresponds to the thickness determined by the superposition and gluing of the two sheets 1 and 2. Starting from the folding line 8', those flaps 7 are depressed and folded downwards, being superposed and fixed by gluing to the lower surface of the lower sheet 2, as is clearly shown in FIG. 5.

Depending on the manner of fitting the corresponding legs 4, the cover 3 may or may not have openings 10 through which this fitting can be done, in particular if this is done by pressure or punching, since if it is done by suction then the said openings 10 will not exist.

Figure 3:
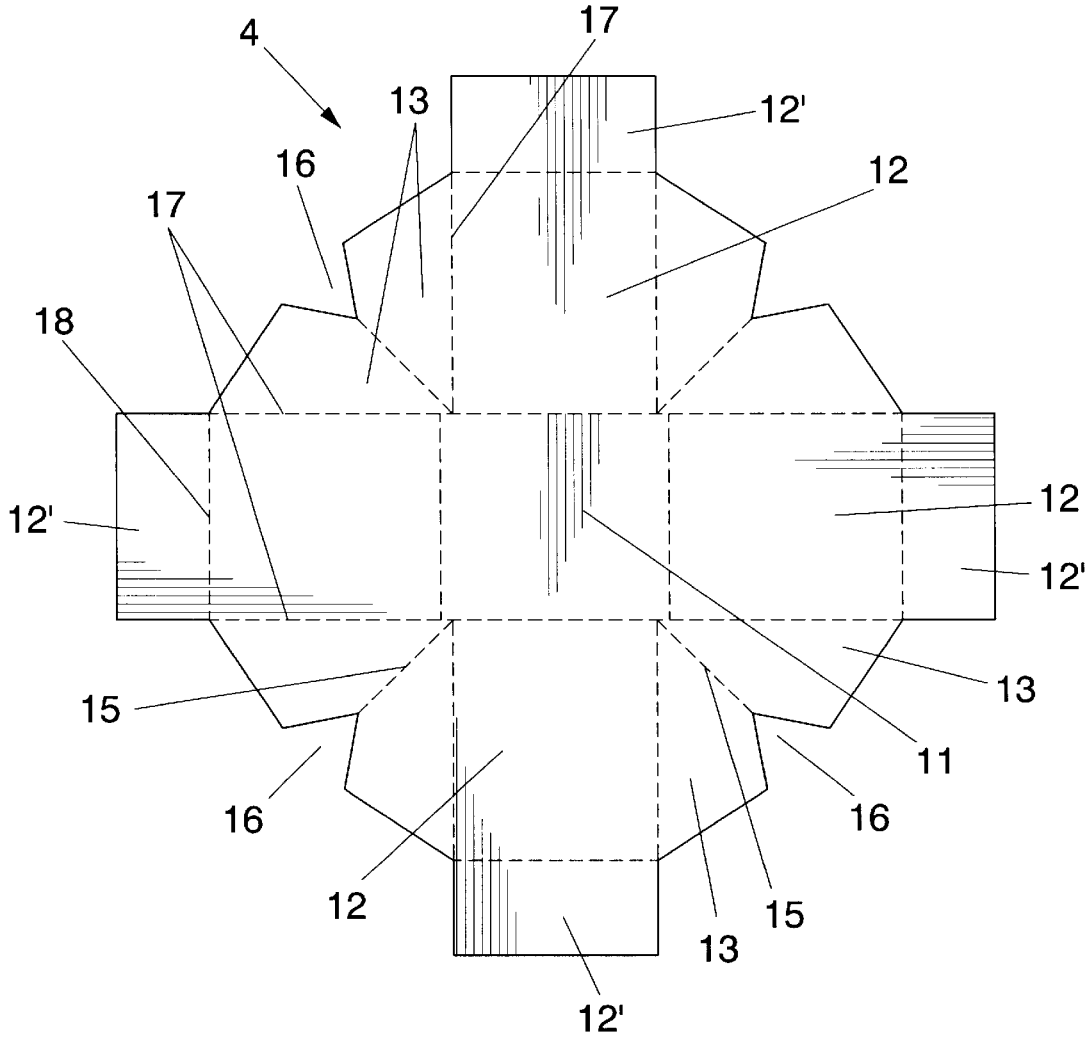
FIG. 3.—Shows a plan view of the development corresponding to the portion of cardboard from which the leg is obtained as a fundamental element of the pallet forming the object of the invention.
Figure 4:
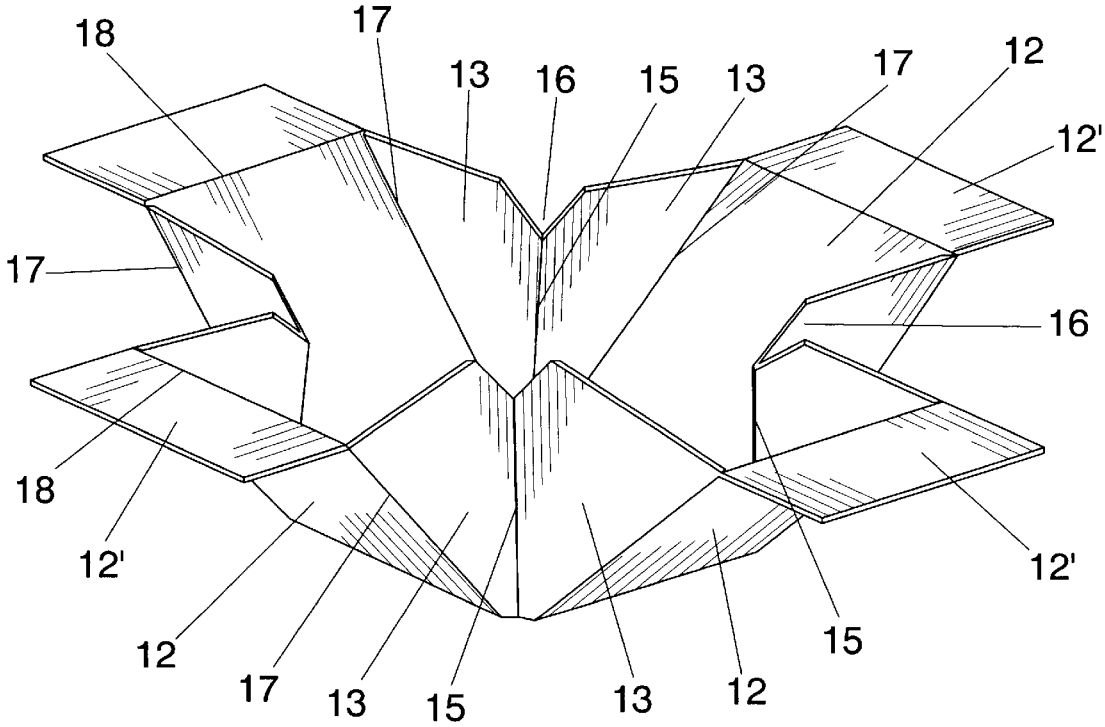
FIG. 4.—Shows a perspective view of an intermediate phase in the folding of the development represented in the previous figure, in order to shape the leg in question.

In terms of the legs 4, each of them is obtained from the development of a portion of cardboard, as represented in FIG. 3, of a polygonal contour in which there exists a central sector 11 from which derive rectangular sectors 12 forming a cross. Between those sectors in a cross 12, pairs of triangular sectors 13 are determined, those of each pair being demarcated by a folding line 15, in correspondence with which or in the common edge between both sectors 13 a notch 16 has been provided, which will allow the strengthening of the leg via the fold that will be made along those folding lines 15, the sectors 13 being folded in pleats towards the inside or towards the outside, and via the folding lines 17 demarcating the rectangular sectors 12 with respect to the pairs of triangular sectors 13. Those rectangular sectors 12 are in turn prolonged in extensions 12' determining flaps demarcated by respective folding lines 18, in such a way that in the folding via those folding lines 15, 17 and 18, as represented in FIG. 4, a leg structure is successfully obtained in the form of a bowl in which the edges that determine the folding lines 15 can be arranged towards the inside or towards the outside and the vertices corresponding to the notches 16 joined in the centre, determining the side flat faces formed from the rectangular sectors 12, while the triangular sectors 13 are folded in an accordion, either towards the inside or towards the outside. The flaps 12' determined by the extensions of the rectangular sectors 12 have a horizontal arrangement and, in the fittings of the legs on the structure of the pallet, they are located on the notches 6, which have the same contour as those flaps 12', these being supported and fixed by gluing on the surface left exposed in the lower sheet 2 via the said notches 6.

Figure 5:
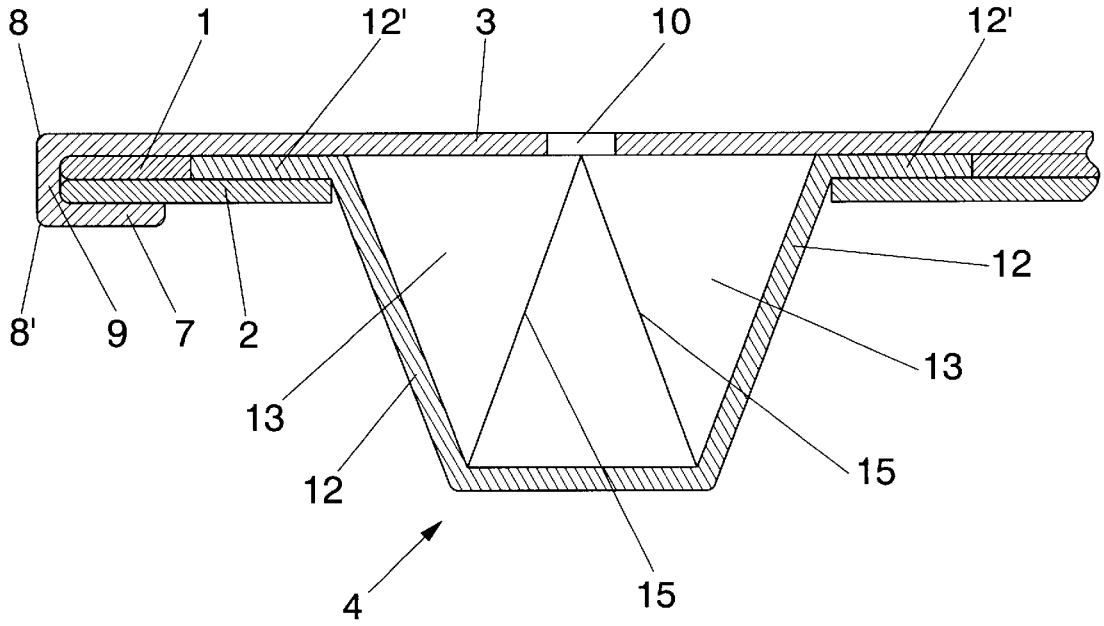
FIG. 5.—Shows a cross-section view of the manner of fitting the leg, along with the structuring of the actual pallet.

Once those legs 4 have been fitted and positioned in the way that is described, the final securing is done by means of the arrangement of the cover 3 which is left superposed on the upper sheet 1, backed of course on the flaps 12' located in the notches 6 of that sheet 1, with which those flaps 12' and sheet 1 are left in the same plane, and on it there rests and is fixed by gluing the referred to cover 3, the flaps 7 embracing the thickness formed by the sheets 1 and 2 and those flaps 7 of the cover 3 being glued underneath the lower sheet 2, as represented in FIG. 5.

Finally, it can be said that the external surface of the legs 4 is duly treated, either by means of applying a plasticized lamina or by means of the application of chemical products, in either case rendering that external surface with a waterproofing which, in combination with the configuration of the legs without any cuts and the hiding of the corrugation of the cardboard, prevents penetration of humidity through the cardboard, which in turn makes the pallet much stronger and durable.

What is claimed is:

1. An improved cardboard pallet, comprising:

a body formed by an upper sheet and a lower sheet of corrugated cardboard which are superposed and glued together, legs of cardboard fixed in a plurality of apertures (5–5') established in the body, an upper cardboard cover superposed and glued on the upper sheet;

wherein each leg is shaped from a development of a portion of cardboard of polygonal contour and comprises:

a central sector defining a support base of the leg, said central sector being demarcated by a plurality of base folding lines, a plurality of first sectors meeting the central sector in the base folding lines, said first sectors being demarcated by the base folding lines, first folding lines and second folding lines, a plurality of second sectors meeting the first sectors in the first folding lines, each second sector having a third folding line, extensions prolonged from the second folding lines in the first sectors defining end flaps projecting with respect to the contour of the leg;

the upper sheet is provided with notches having apertures; so as to fold and shape the leg with a bowl-shaped configuration, the flaps being positioned in the notches of the upper sheet, said flaps being fixed by gluing on a surface of the lower sheet which remains exposed via the notches of the upper sheet, said legs having a support or external surface that is fully waterproofed by combining a configuration without cuts together with a surface treatment selected from plasticization, coating and combinations thereof.

2. An improved cardboard pallet according to claim 1, wherein the polygonal contour of the legs defines at least four first sectors conferring to said legs a quadrangular structure in plan view.

3. An improved cardboard pallet according to claim 1, wherein the apertures in the upper sheet and in the lower sheet for fitting the leg, are of polygonal contour, with notches being made in the upper sheet for positioning the flaps of the leg.

4. An improved cardboard pallet according to claim 1, wherein the first sectors of the leg are rectangular and show a cross pattern in the development from which the leg is shaped, the rectangular first sectors are crossed in the central sector, the second sectors, determined between the rectangular first sectors are pairs of triangular sectors, each pair of the second triangular sectors has an angular notch in the polygonal contour of the development, said angular notch determining the third folding line which is common to both triangular second sectors in each pair, so as to fold all sectors and to shape the leg, in which upper vertices originated in the folding by the pairs of said triangular sectors, meet in a central part of the an open upper base of the bowl having a truncated-pyramidal configuration.

5. An improved cardboard pallet according to claim 1, wherein the upper cover which secures the flaps of the legs comprises perimetric flaps which are folded and are fixed by gluing on a lower surface of the lower sheet, said perimetric flaps comprising a fourth folding line and a fifth folding line, so as to permit a depression downwards and inwards of the perimetric flaps, portion of the perimetric flap between the fourth folding line and the fifth folding line corresponding to a thickness of the upper sheet and the lower sheet for permitting depression downwards and a superposition of the flaps on the lower surface of the sheet.

* * * * *